US006668595B2

(12) United States Patent
Shibuta

(10) Patent No.: US 6,668,595 B2
(45) Date of Patent: Dec. 30, 2003

(54) WEFT KNITTING MACHINE WITH TRANSFER MECHANISM

(75) Inventor: Takekazu Shibuta, Wakayama (JP)

(73) Assignee: Shima Seiki MFG., Ltd., Wakayama (JP)

( * ) Notice: Subject to any disclaimer, the term of this patent is extended or adjusted under 35 U.S.C. 154(b) by 0 days.

(21) Appl. No.: 10/275,262

(22) PCT Filed: May 16, 2001

(86) PCT No.: PCT/JP01/04088

§ 371 (c)(1),
(2), (4) Date: Nov. 8, 2002

(87) PCT Pub. No.: WO01/88242

PCT Pub. Date: Nov. 22, 2001

(65) Prior Publication Data

US 2003/0106343 A1 Jun. 12, 2003

(30) Foreign Application Priority Data

May 18, 2000 (JP) ..... 2000-146978

(51) Int. Cl.[7] ..... D04B 7/04
(52) U.S. Cl. ..... 66/64
(58) Field of Search ..... 66/64, 148, 60 R, 66/66, 69, 72, 61, 120, 147

(56) References Cited

U.S. PATENT DOCUMENTS 5,343,719 A * 9/1994 Nakamori et al. ..... 66/75.1
5,398,527 A * 3/1995 Hirai et al. ..... 66/148
5,636,532 A * 6/1997 Shima et al. ..... 66/64
5,992,184 A * 11/1999 Shibuta ..... 66/64
6,018,966 A * 2/2000 Shima ..... 66/75.1
6,047,569 A * 4/2000 Shima ..... 66/64
6,079,231 A * 6/2000 Shima ..... 66/64
6,109,067 A * 8/2000 Shibuta ..... 66/64
6,381,992 B1 * 5/2002 Haltenhof ..... 66/64

FOREIGN PATENT DOCUMENTS

EP 955402 11/1999
JP 3000461 11/1999

* cited by examiner

*Primary Examiner*—Danny Worrell
(74) *Attorney, Agent, or Firm*—Rothwell, Figg, Ernst & Manbeck

(57) ABSTRACT

There are provided a transfer jack (6, 102) which is structured so that when a loop retaining portion (48, 122) is advanced to an advanced position over a needle bed gap (42) between front and back needle beds (2*a*, 2*b*), the loop retaining portion can be held in such a manner as to swing between its raised position and its lowered position; transfer jack holding means (64, 110) for holding the loop retaining portion in its raised position at least as high as a level to avoid interference with knitting members arranged on the needle beds (2*a*, 2*b*) while the needle bed is racked, when the loop retaining portion (48, 122) of the transfer jack (6, 102) retaining a loop (36) thereon is in the advanced position; and transfer jack controlling means (82) for controlling the transfer jack holding means to selectively hold the loop retaining portion (48, 122) of the transfer jack (6, 102) in its raised position and release it from its held state.

2 Claims, 8 Drawing Sheets

WEFT KNITTING MACHINE WITH TRANSFER MECHANISM

TECHNICAL FIELD

The present invention relates to a flat knitting machine with transfer mechanism comprising a transfer jack bed (hereinafter it is referred to as "TR jack bed") in which a number of transfer jacks (hereinafter they are referred to as "TR jack") each having a loop retaining portion at a front end thereof are embedded and which is arranged over needle beds, and a transfer cam mechanism for transferring the loop between the TR jacks of the TR jack bed and the knitting needles of the needle beds.

BACKGROUND ART

A flat knitting machine comprising a pair of front and back needle beds holding knitting needles in such a manner as to be advanced and retracted in needle grooves formed on upper surfaces of the needle beds, at least either of which is racked horizontally with respect to the opposite needle bed, and at least one transfer jack bed located over the at least one needle bed and holding transfer jacks in such a manner as to freely advance and retract in the grooves formed on an upper surface thereof is known from Japanese Patent No. 2794144. In the flat knitting machine disclosed by this publication, the TR jack bed and the needle beds are structured so that they can be racked longitudinally relative to each other to transfer a loop between the knitting needles of the front and back needle beds and between the knitting needle of the needle bed and the TR jack of the TR jack bed. The flat knitting machine thus structured enables a loop retained by the knitting needle of the needle bed to be transferred to an adjacent needle of the same needle bed by transferring the loop retained by the knitting needle of the needle bed to the TR jack of the TR jack bed, first; then racking the TR jack bed; and then transferring the loop retained by the TR jack to the adjacent needle of the needle bed.

Japanese Laid-open (Unexamined) Patent Publication No. Hei 11 (1999)-1850 discloses a flat knitting machine with a transfer mechanism which is structured so that when a loop retaining portion of the TR jack is retracted across a loop retained on the TR jack to transfer the loop to a knitting needle, the TR jack can be retracted while keeping its front end in the depressed state.

In the flat knitting machine disclosed by the publication of Japanese Patent No. 2794144 cited above, the TR jack is advanced and retracted linearly in the horizontal direction on a level higher than a front end of the needle bed. Due to this, when the loop retained on the TR jack is transferred to the knitting needle, the loop is stretched and elongated to deteriorate the quality of the knitted fabric.

To solve this problem involved in the publication of Japanese Patent No. 2794144, the flat knitting machine disclosed in Japanese Laid-open (Unexamined) Patent Publication No. Hei 11 (1999)-1850 is structured so that when the loop retaining portion of the TR jack is retracted across the loop retained on the TR jack to transfer the loop to the knitting needle, the TR jack can be retracted, while keeping its front end in the depressed state, to reduce the load on the loop.

However, both of the flat knitting machines disclosed by the publications cited above are structured so that when the TR jack is in its advanced position over the needle bed gap between the needle beds, the TR jack can be positioned on a level higher than the front ends of the needle beds, in order to avoid interference with the knitting needle and the sinker plate on the needle bed when racked. In this structure, the loop retaining portion at the front end of the TR jack cannot be swung vertically in the advanced position of the TR jack. Due to this, a load is put on the loop retained on the loop retaining portion of the TR jack in the advanced position of the TR jack.

In the light of the problems mentioned above, the present invention has been made. It is an object of the invention to provide a flat knitting machine with a transfer mechanism wherein when the loop retaining portion of the TR jack is in its advanced position, the loop retaining position of the TR jack can be held in its raised position or released therefrom in a selective manner and also can be lowered an increased distance to further reduce the load on the loop.

DISCLOSURE OF THE INVENTION

The present invention provides a flat knitting machine with a loop transfer mechanism comprising a pair of front and back needle beds, arranged in a confronting relation and holding knitting needles in such a manner as to freely advance and retract in grooves formed in upper surfaces of the needle beds, at least one of which is racked relative to the opposite needle bed, and at least one transfer jack bed, provided over the at least one needle bed and holding transfer, jacks, each having a loop retaining portion at a front end portion thereof, in such a manner as to freely advance and retract in grooves formed in upper surface of the at least one transfer jack bed, wherein the transfer jack is structured so that when the loop retaining portion is advanced to an advanced position over a needle bed gap between the front and back needle beds, the loop retaining portion can be held in such a manner as to swing between its raised position and its lowered position;

wherein there is provided transfer jack holding means for holding the loop retaining portion in its raised position at least as high as a level to avoid interference with knitting members arranged on the needle beds while the needle bed is racked, when the loop retaining portion of the transfer jack retaining a loop thereon is in the advanced position; and wherein there is provided transfer jack controlling means for controlling the transfer jack holding means to selectively hold the loop retaining portion of the transfer jack in its raised position and release it from its held state.

wherein the transfer jack holding means includes a transfer jack controlling member which is fitted in a recess formed in the transfer jack bed in a freely advance-and-retract manner;

wherein the transfer jack controlling member and the transfer jack are brought into engagement with each other by their relative movement in the advancing-and-retracting direction, whereby the loop retaining portion of the transfer jack is held in its raised position when the loop retaining portion is in its advanced position; and wherein when the loop retaining portion is in the advanced position, the transfer jack controlling member is moved to release the engagement between the transfer jack controlling member and the transfer jack, so as to allow the loop retaining portion of the transfer jack to be lowered.

It is preferable that the recess is formed on a top surface of the transfer jack and the transfer jack controlling member is slidably fitted in the recess; wherein the recess has an engaging portion, formed at a bottom of the recess at a rear end portion thereof, to engage with a rear end portion of the transfer jack controlling member; wherein a notch for the rear end portion of the transfer jack controlling member to be inserted into so as to allow the transfer jack to swing is formed in the bottom of the recess at a location forward of the engaging portion; and wherein the transfer jack controlling means puts the transfer jack controlling member in a location at a rear of the recess to bring the transfer jack and the transfer jack controlling member into engagement with each other and puts the transfer jack controlling member in a location at a front of the recess to release the engagement between the transfer jack and the transfer jack controlling member.

It is preferable that the transfer jack holding means includes a transfer jack controlling member which is fitted in a recess formed in the transfer jack bed in a freely advance-and-retract manner; wherein the transfer jack controlling member and the transfer jack are brought into engagement with each other by their relative movement in the advancing-and-retracting direction, whereby the loop retaining portion of the transfer jack is held in its raised position when the loop retaining portion is in its advanced position; and wherein when the loop retaining portion is in the advanced position, the transfer jack controlling member is moved to release the engagement between the transfer jack controlling member and the transfer jack, so as to allow the loop retaining portion of the transfer jack to be lowered.

It is preferable that the recess is formed on a top surface of the transfer jack and the transfer jack controlling member is slidably fitted in the recess; wherein the recess has an engaging portion, formed at a bottom of the recess at a rear end portion thereof, to engage with a rear end portion of the transfer jack controlling member; wherein a notch for the rear end portion of the transfer jack controlling member to be inserted into so as to allow the transfer jack to swing is formed in the bottom of the recess at a location forward of the engaging portion; and wherein the transfer jack controlling means puts the transfer jack controlling member in a location at a rear of the recess to bring the transfer jack and the transfer jack controlling member into engagement with each other and puts the transfer jack controlling member in a location at a front of the recess to release the engagement between the transfer jack and the transfer jack controlling member.

BEST MODE FOR CARRYING OUT THE INVENTION

Figure 1:
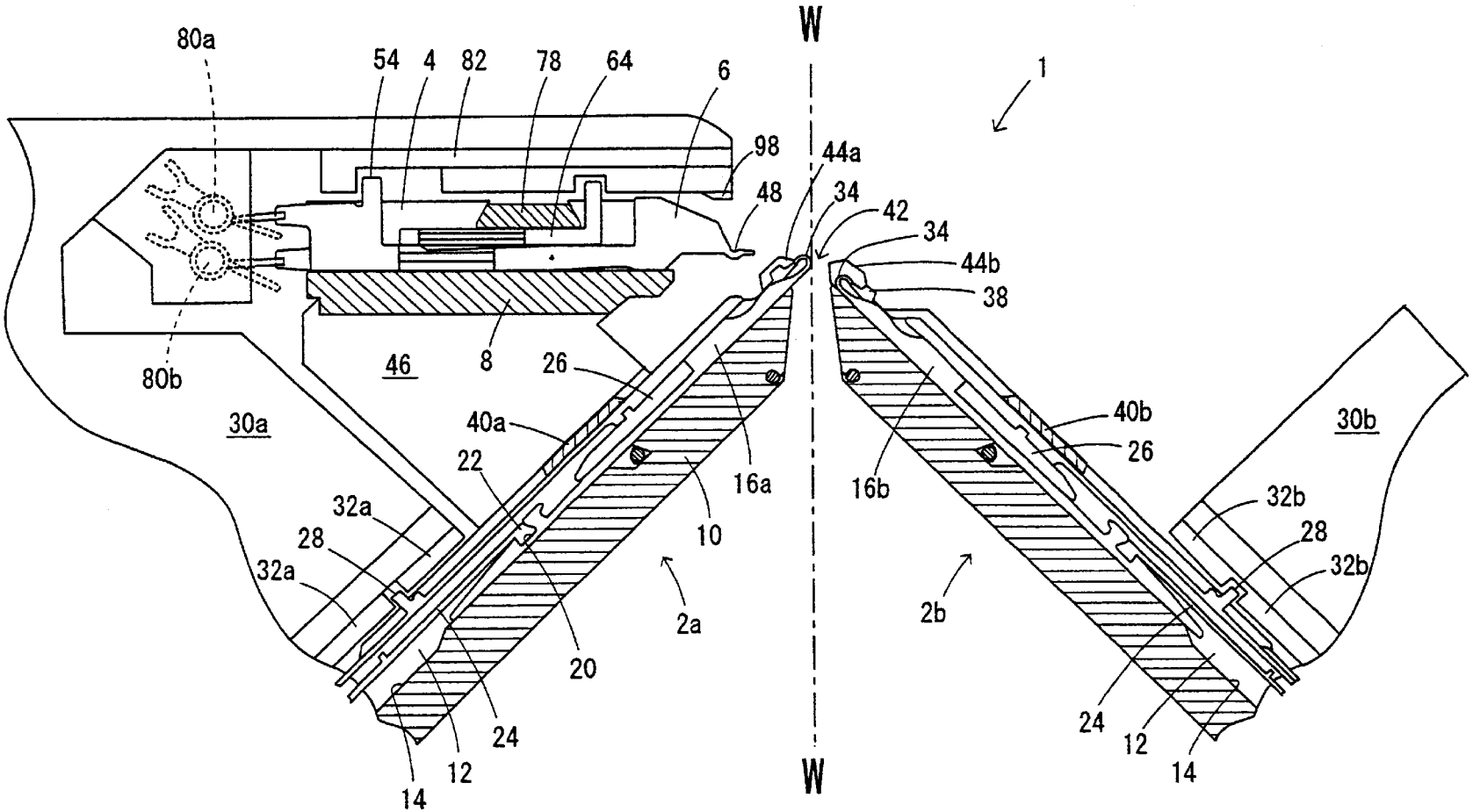
FIG. 1 is a vertical sectional view of a flat knitting machine with a transfer mechanism according to an embodiment of the present invention.
Figure 2:
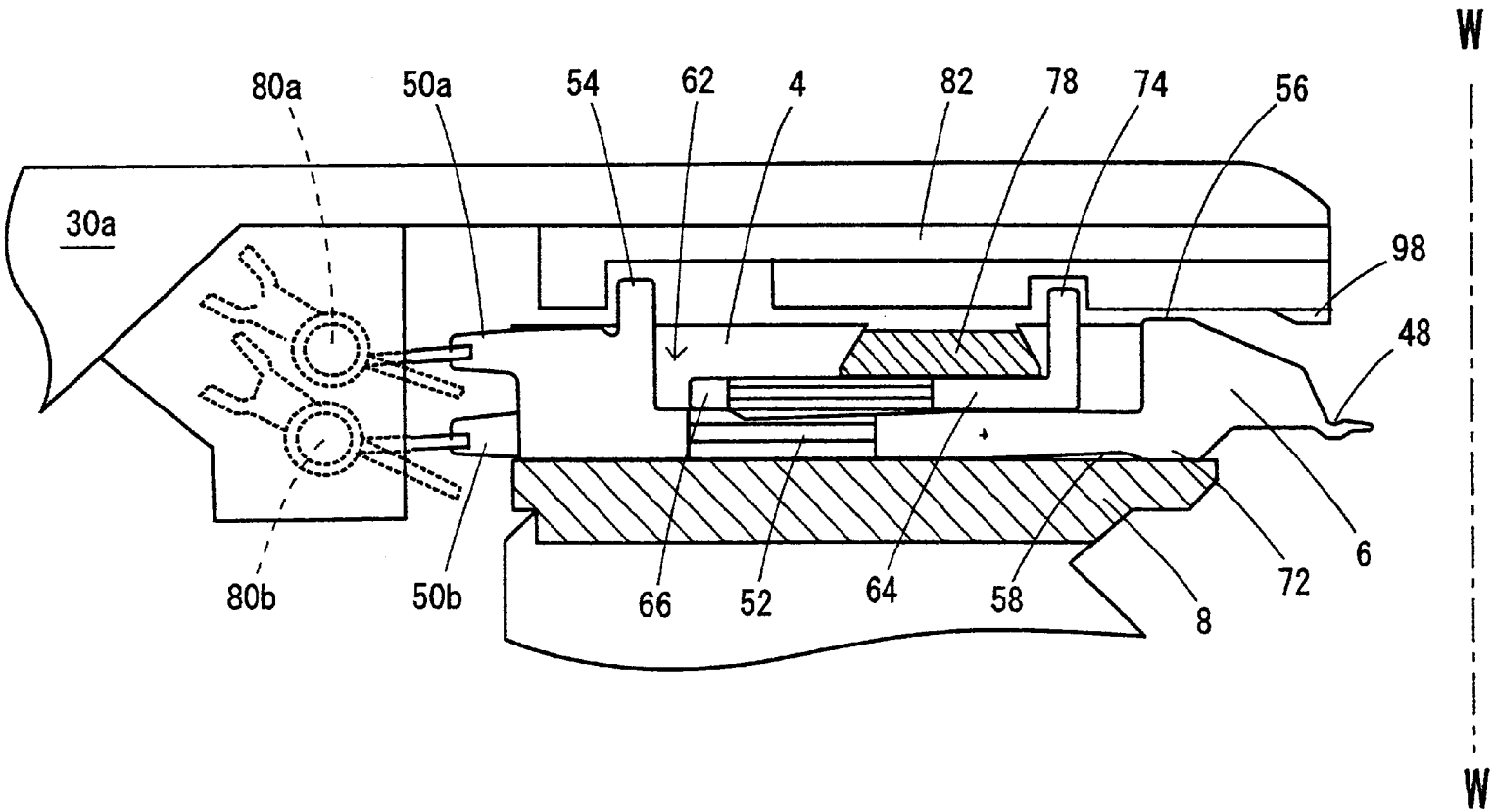
FIG. 2 is a partly enlarged view of FIG. 1.
Figure 3:
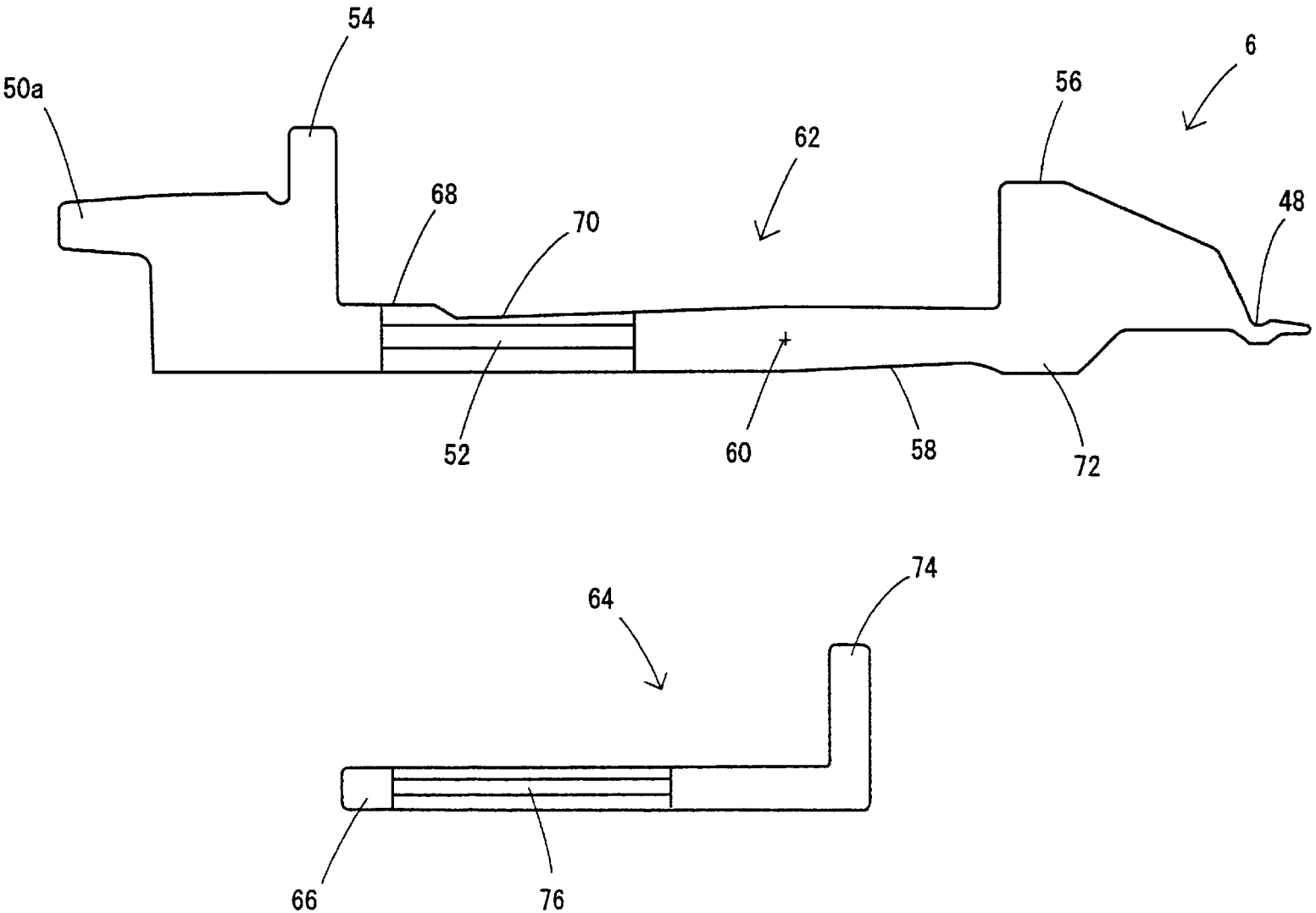
FIG. 3 is a side elevation view of a TR jack and a TR jack controlling member.
Figure 4:
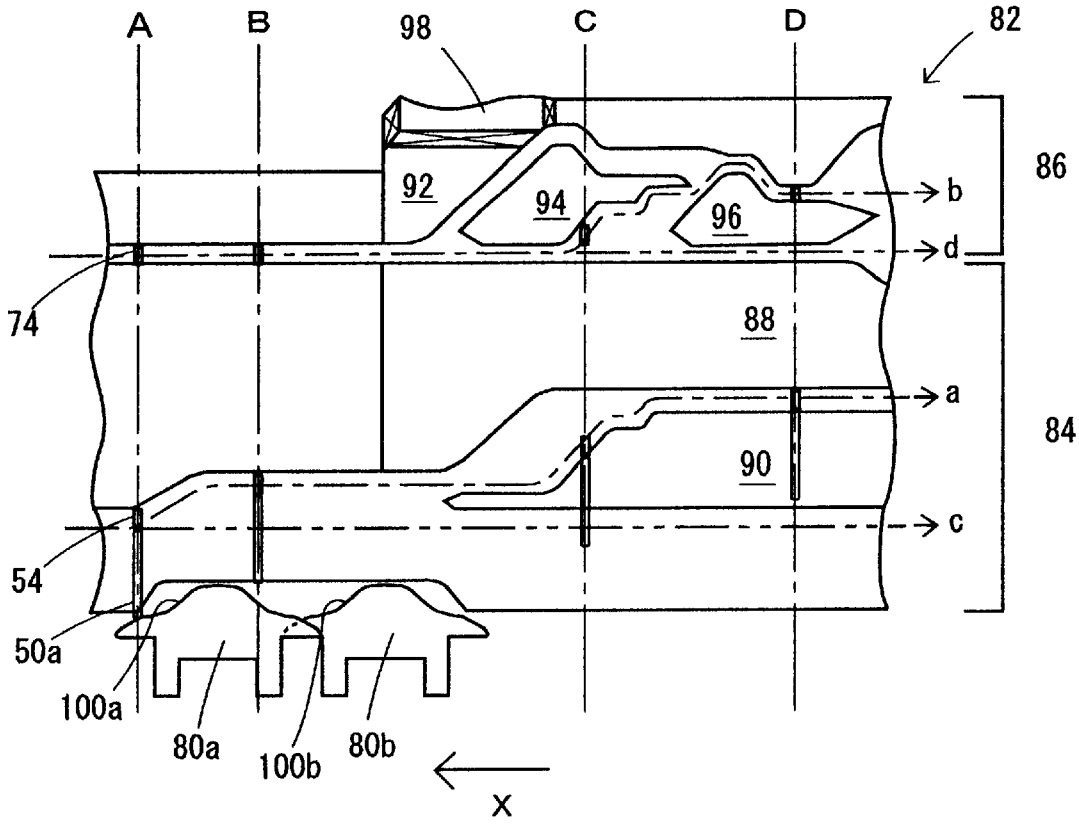
FIG. 4 is a perspective view of a TR jack control cam operated when the loop is transferred from a knitting needle to the TR jack.

In the following, certain preferred embodiments of the present invention will be described with reference to the accompanying drawings. FIG. 1 is a vertical sectional view of a flat knitting machine and reference numeral 1 denotes the entirety of the flat knitting machine. FIG. 2 is a partly enlarged view of FIG. 1. FIG. 3 is a side elevation view of a TR jack and a transfer jack controlling member (hereinafter it is referred to as "TR jack" controlling member). FIG. 4 is a perspective view of a group of TR jack control cams.

The flat knitting machine 1 comprises a pair of front and back needle beds 2*a*, 2*b* arranged in an inversed V shape with their front ends confronting each other and a TR jack bed 8 placed over the front needle bed 2*a* (hereinafter it is simply referred to as the front bed) and holding TR jacks 6 in TR jack grooves 4 formed in an upper surface of the TR jack bed. The TR jack bed 8 is so structured as to be racked in a longitudinal direction of the needle beds 2*a*, 2*b* by drive means, not shown. The needle beds 2*a*, 2*b* are provided with needle plates 12 standing in the grooves formed on a needle bed base plate 10. Needle grooves 14 are formed between the adjacent needle plates 12, 12, and the knitting needles 16*a*, 16*a* are held in the needle grooves 14 in such a manner as to be advanced toward a center line W-W of a needle bed gap between the front and back needle beds 2*a*, 2*b* and retracted therefrom. The front bed 2*a* and the back needle bed 2*b* (hereinafter it is simply referred to as the back bed) are so structured as to be racked in the longitudinal direction of the needle bed 2*a*, 2*b* by means of drive means, not shown.

In the illustration, the flat knitting machine uses slide needles. Each slide needle is structured so that a hook 34 of a knitting needle 16 placed in the needle groove 14 is opened and closed by a butt, not shown, of a needle jack 24 having a protrusion 22 to be engaged with a recess 20 formed at the rear end of the needle 16 and a butt 28 of a slider 26 being advanced and retracted via cams 32*a*, 32*b* on a pair of front and back carriages 30*a*, 30*b* which are moved in reciprocation by driving means, not shown.

The slider 26 is formed by two thin plates being combined in an overlapped relation. When the slider 26 is advanced toward the hook 34 of the needle 16, front end portions of the slider 26 are spread out by the hook 34 of the needle 16 to form a loop transfer space in a loop 36. The loop 36 is retained on a shoulder portion 38 of the spread-out slider 26 and is raised up to the loop transfer position. The knitting needle 16 is held in the needle groove 14 via a band 40 fitted therein in the longitudinal direction of the needle bed 2. The needle jack 24 is placed in the needle groove 14, together with a select jack and a selector, not shown, and is so structured that when pressed by a presser of the carriage 30 in the direction of being sunk into the needle groove 14, the needle jack 24 causes the butt to move down to a disengaged position from the cam on the carriage 30.

Fixed sinkers 44*a*, 44*b* are provided between the adjacent needles 16, 16 at the needle bed gap 42 between the front and back needle beds 2*a*, 2*b*. The TR jack bed 8 has the supporting portions formed by upwardly extended portions 46 of the needle plates 12 placed at a specified distance in the front bed 2*a*. The TR jack bed 8 holds the TR jacks 6 in the TR jack grooves 4 formed at the same pitch as the pitch of the needle grooves 14 in the needle bed 2*a*. Each of the TR jacks 6 has a loop retaining portion 48 formed at a front end thereof and needle selecting butts 50*a*, 50*b* formed at a rear end thereof. The TR jack 6 is pressed against a side wall of the TR jack groove 4 by a bending portion 52, to prevent the rash action.

The TR jack 6 has, on the top surface, an advancing-and-retracting motion controlling butt 54 having front and back surfaces to abut with the cam on the carriage 30*a*; a clearing cam acting portion 56 provided at a front end portion of the TR jack 6; and the bending portion 52 arranged therebetween. Also, the TR jack 6 has, on a bottom surface thereof, an inclined surface 58 which becomes gradually higher toward the front end and has a configuration to allow the TR jack 6 to swing around a virtual axis 60.

The TR jack 6 has a recess 62 formed between the advancing-and-retracting motion controlling butt 54 and the clearing cam acting portion 56. The recess 62 has an engaging surface 68, formed on a bottom thereof, to engage with a rear end portion 66 of the TR jack controlling member 64 as mentioned later. The recess 62 has a notch 70 formed in the engaging surface 68. The notch 70 has an inclined surface which becomes gradually higher toward the front end, extending from a location forward of the engaging surface 68 and lower than a plane of the bottom of the recess 62 to a location over the virtual axis 60, so that when the TR jack 6 swings around the virtual axis 60, the rear end portion 66 of the TR jack controlling member 64 can be received in the notch 70.

Also, the TR jack 6 has a protrusion 72 formed at the bottom. When the TR jack 6 is retracted, the protrusion 72 is brought into abutment with the TR jack bed 8 and pushes the loop retaining portion 48 of the TR jack 6 up to its raised position.

The TR jack controlling member 64 is slidably fitted in the recess 62 formed between the advancing-and-retracting motion controlling butt 54 and the clearing cam acting portion 56. The TR jack controlling member 64 has, on the top at a front end portion thereof, an advancing-and-retracting motion controlling butt 74 having front and rear surfaces with which the cam mounted on the carriage 30*a* is abutted. The TR jack controlling member 64 has a bending portion 76 which is formed between the rear end portion 66 and the advancing-and-retracting motion controlling butt 74 to press the TR jack controlling member 64 against the side wall of the TR jack groove 4, so as to prevent the rash action.

The TR jack 6 and the TR jack controlling member 64 are held in the TR jack groove 4 by a band 78 fitted therein in the longitudinal direction of the TR jack bed 8. When the rear end portion 66 of the TR jack controlling member 64 rides on the engaging surface 68 of the TR jack 6, the TR jack 6 and the TR jack controlling member 64 are brought into engagement with each other and the TR jack 6 is held down from above by the band 78 through the TR jack controlling member 64. As a result of this, the swinging motion of the TR jack 6 is suppressed and the TR jack 6 holds the loop retaining portion 48 in its raised position.

When the TR jack 6 is in the advanced position where the protrusion 72 of the TR jack 6 is not abutted with the TR jack bed 8, the TR jack controlling member 64 is moved to release the riding relation or the engagement between the engaging surface 68 of the TR jack 6 and the rear end portion 66 of the TR jack controlling member 64. Then, the gap by the notch 70 is left between the TR jack 6 and the rear end portion 66 of the TR jack controlling member 64. The gap thus formed and the inclined surface 58 formed on the bottom of the TR jack 6 enable the TR jack 6 to swing around the virtual axis 60.

Two different groups of TR jacks 6, on which the needle selection butt 50*a*, 50*b* are formed at different positions, respectively, are arranged alternately every one inch on the TR jack bed 8. The TR jacks 6 selected by needle selection actuator 80*a*, 80*b* disposed in different phases of the carriage 30 with respect to the moving direction of the carriage 30 are advanced toward and retracted from the needle bed gap 42.

TR jack control cams 82 mounted on the carriages 30*a* comprise a first cam group 84 and a second cam group 86. The first cam group 84 acts on the advancing-and-retracting motion controlling butt 54 of the TR jack 6, and the second cam group 86 acts on the advancing-and-retracting motion controlling butt 74 of the TR jack controlling member 64 and the clearing cam acting portion 56 of the TR jack 6.

The first cam group 84 comprises guide cams 88, 90, and the second cam group 86 comprises guide cams 92, 94, 96 and a clearing cam 98 to act on the cam operating portion 56.

In the illustrated embodiment, a track for the advancing-and-retracting motion controlling butt 54 of the TR jack 6 selected to be in its advanced position and a track for the advancing-and-retracting motion controlling butt 74 of the TR jack controlling member 64 selected to be in its advanced position are formed to be different from each other.

In the illustrated embodiment, movable guide cams, such as retractable guide cams, may be used in place of the fixed guide cams 88, 90, 92, 94, 96 mounted on the carriages 30*a*.

Needle selection actuators 80*a*, 80*b* each have an acting surface 100*a*, 100*b* which is high at a center portion thereof and low at both ends thereof with respect to the moving direction of the carriage 30*a*. When the TR jacks 6 used for the loop transfer pass through the needle selection actuators 80*a*, 80*b*, the needle selection actuators are shifted from the inoperative position to the operative position, so that the needle selection butts 50*a*, 50*b* are pushed out forward by the acting surfaces 100*a*, 100*b*. When the TR jacks 6 unused for the loop transfer pass through the needle selection actuators, the needle selection actuators 80*a*, 80*b* are held in their inoperative positions to prevent those TR jacks 6 from being advanced.

In the following, description will be given on operation in the knitting process wherein the loop 36 retained on the knitting needle 16*b* of the back bed 2*b* is transferred to the TR jack 6, first, and, then, after the back bed 2*b* is racked, the loop as was transferred to the TR jack is transferred to an adjacent knitting needle 16*b* of the back bed 2*b*.

Figure 5:
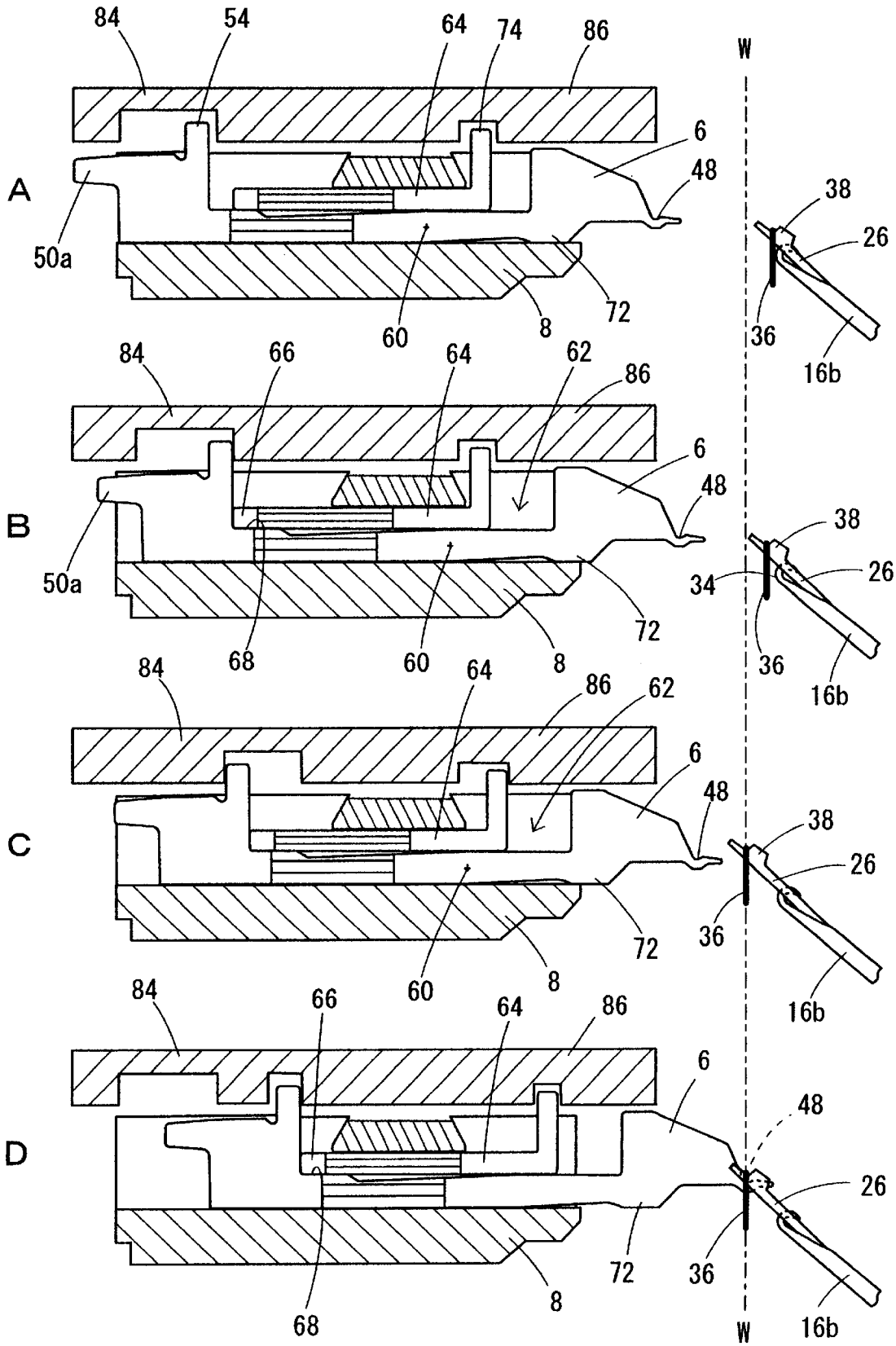
FIG. 5 shows the TR jack, the TR jack controlling member and the knitting needle when the TR jack and the TR jack controlling member are in the positions A–D of FIG. 4.

With reference to FIGS. 4 and 5, the loop transfer from the knitting needle 16*b* of the back bed 2*b* to the TR jack 6 will be described.

FIG. 5 A–D show the relations among the TR jack 6, the TR jack controlling member 64 and the knitting needle 16*b* when the advancing-and-retracting motion controlling butt 54 of the TR jack 6 and the advancing-and-retracting motion controlling butt 74 of the TR jack controlling member 64 are in the positions A–D in FIG. 4. The arrow X of FIG. 4 indicates the traveling direction of the carriage 30*a*. The advancing-and-retracting motion controlling butt 54 of the TR jack 6 and the advancing-and-retracting motion controlling butt 74 of the TR jack controlling member 64 are traveled from left to right.

In FIG. 4, the advancing-and-retracting motion controlling butt 54 of the TR jack 6 selected to be in the advanced position in order to transfer the loop from the knitting needle 16*b* of the back bed 2*b* to the TR jack is moved along the track "a" and the advancing-and-retracting motion controlling butt 74 of the TR jack controlling member 64 selected is moved along the track "b". The advancing-and-retracting motion controlling butt 54 of the TR jack 6 unselected to be in the advanced position is moved along the track "c" and the advancing-and-retracting motion controlling butt 74 of the TR jack controlling member 64 unselected is moved along the track "b".

The TR jacks 6 and the TR jack controlling member 64 are moved from left to right in the course where the loop is transferred. When the TR jacks 6 and the TR jack controlling member 64 are moved up to the position A of FIG. 4, the needle selection actuator 80*a* is shifted from the inoperative position to the operative position, in order to advance the TR jack 6 to receive the loop 36.

When the TR jack 6 and the TR jack controlling member 64 are moved up to the position B, the knitting needle 16*b* of the back bed 2*b* from which the loop 36 is transferred is raised up to the loop transfer position, after the loop 36 goes, out of the hook 34 of the knitting needle 16*b* and is retained on the shoulder 38 of the slider 26. The TR jack 6 to which the loop 36 is transferred starts advancing toward the needle bed gap 42, after the needle selection butts 50*a* of the selected TR jack 6 are abutted with the acting surfaces 100*a* of the needle selection actuators 80*a*.

As a result of the TR jack 6 being advanced by the needle selection actuators 80*a,* the rear end portion 66 of the TR jack controlling member 64 rides on the engaging surface 68 in the recess 62 formed in the TR jack 6, as shown in FIG. 5-B, bringing the TR jack 6 into engagement with the TR jack controlling member 64.

In the position C, the TR jack 6 is further advanced toward the needle bed gap 42 by the guide cam 90. In parallel with this, the TR jack controlling member 64 located in the recess 62 of the TR jack 6 is also moved toward the needle bed gap by the advance of the TR jack 6. Also, the slider 26 retaining the loop 36 on its shoulder 38 is further raised to place the loop 36 in position on the center line W-W of the needle bed gap.

In the positions A–C, since the protrusion 72 formed at the bottom of the TR jack 6 is in abutment with the TR jack bed 8 and also the rear end portion 66 of the TR jack controlling member 64 rides on the engaging surface 68 of the TR jack 6, the TR jack 6 holds the loop retaining portion 48 in the raised position, without swinging around the virtual axis 60.

In the position D, the loop retaining potion 48 of the TR jack 6 is advanced to its advanced position and goes into the loop 36 retained on the slider 26. In the position D, although the TR jack 6 is put in the advanced position where the protrusion 72 of the TR jack 6 is not in abutment with the TR jack bed 8, since the rear end portion 66 of the TR jack controlling member 64 is in the position to ride on the engaging surface 68 of the TR jack 6 and thereby the TR jack 6 and the TR jack controlling member 64 are in engagement with each other, the TR jack 6 holds the loop retaining portion 48 in the raised position, without swinging. Then, the knitting needle 16*b* is moved downwards, to transfer the loop 36 from the knitting needle 16*b* to the TR jack 6. Then, the carriages 30*a,* 30*b* pass, with the loop retaining portion 48 of the TR jack 6 receiving the loop 36 thereon kept in its raised position. This state is kept unchanged even after the passage of the carriages 30*a,* 30*b*. Then, the back bed 2*b* is racked. Since the loop retaining portion 48 of the TR jack 6 is held in its raised position during the racking of the back bed, the loop retaining portion 48 is prevented from being interfered with the knitting members such as the sinker plates 44*a,* 44*b* and the knitting needles 16*a,* 16*b*.

Figure 6:
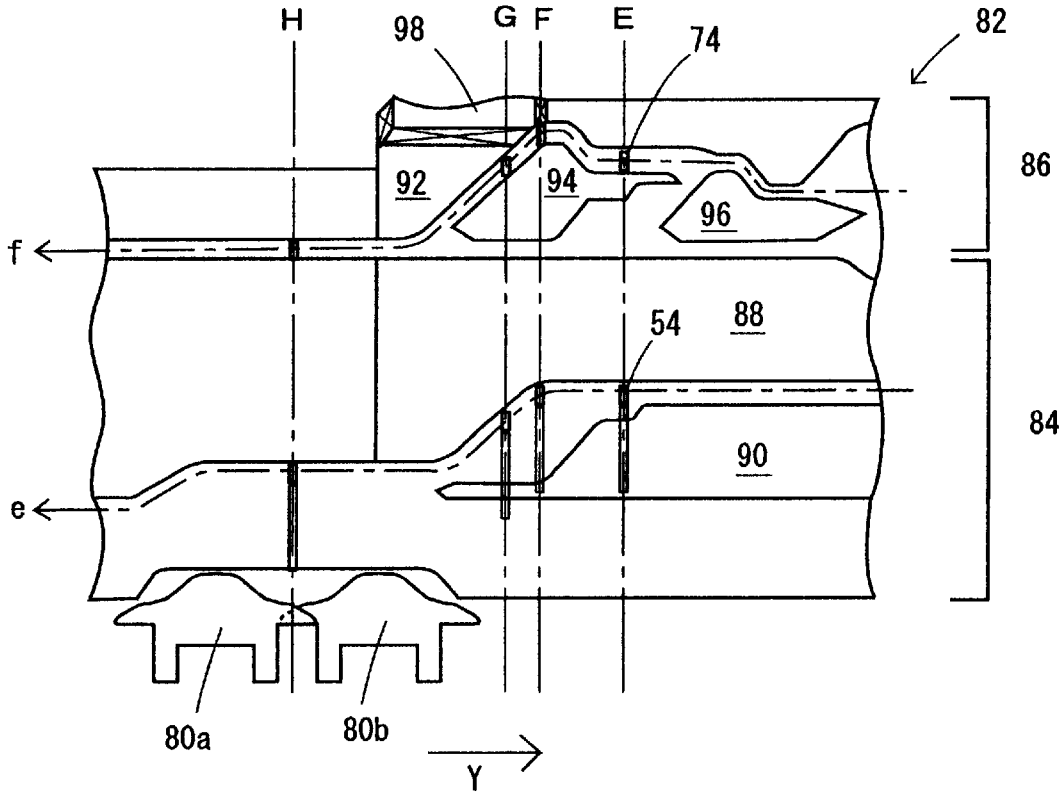
FIG. 6 is a perspective view of the TR jack control cam operated when the loop is transferred from the TR jack to the knitting needle.
Figure 7:
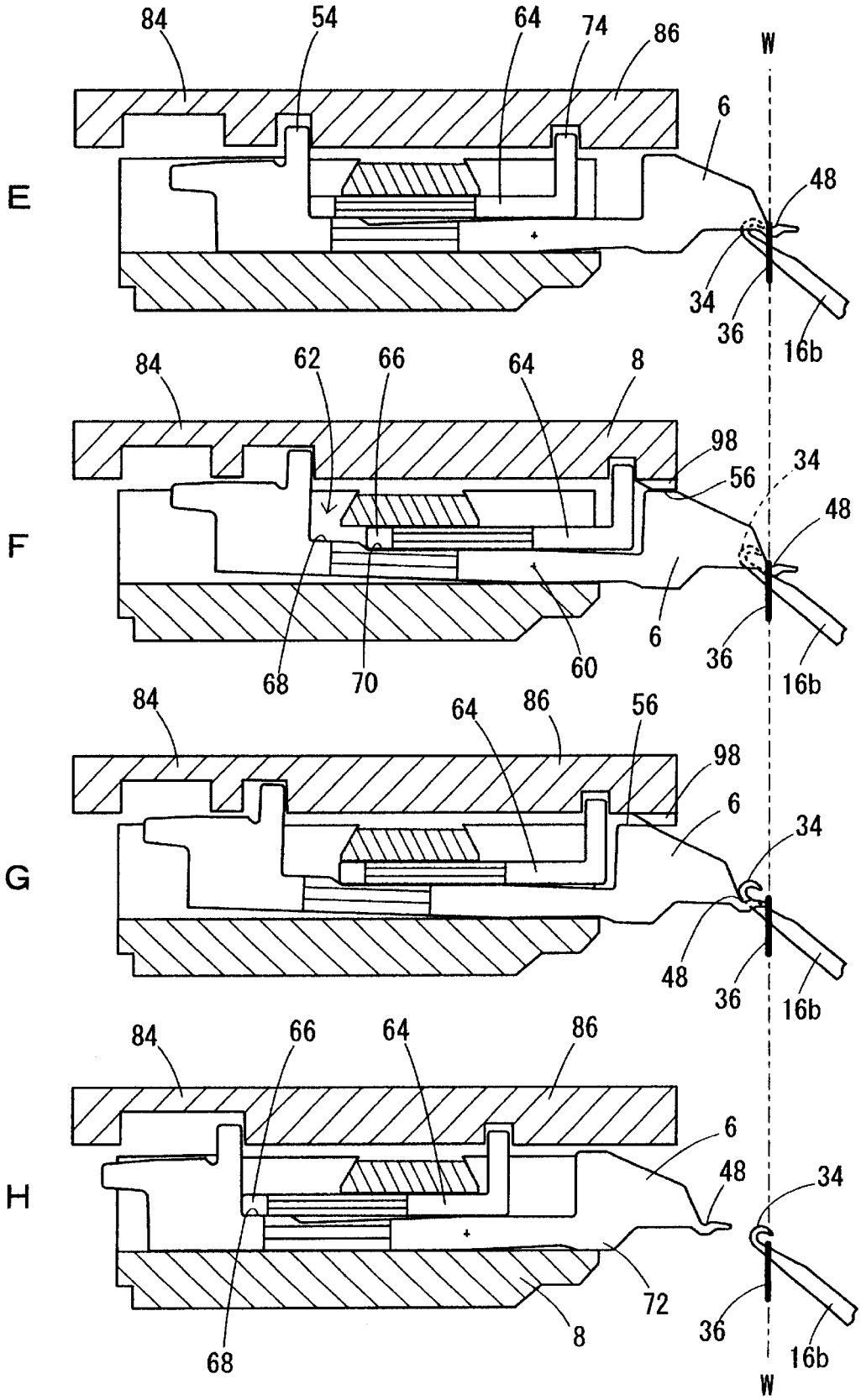
FIG. 7 shows the TR jack, the TR jack controlling member and the knitting needle when the TR jack and the TR jack controlling member are in the positions E–H of FIG. 6.

Next, with reference to FIGS. 6 and 7, the loop transfer from the TR jack 6 to the knitting needle 16*b* of the back bed 2*b* will be described. FIG. 6 is a perspective view of the TR jack control cam 82. FIG. 7-E–H shows the relations among the TR jack 6, the TR jack controlling member 64 and the knitting needle 16*b* when the advancing-and-retracting motion controlling butt 54 of the TR jack 6 and the advancing-and-retracting motion controlling butt 74 of the TR jack controlling member 64 are in the positions E–H of FIG. 6. The arrow Y of FIG. 6 indicates the traveling direction of the carriage 30*a*. The advancing-and-retracting motion controlling butt 54 of the TR jack 6 and the advancing-and-retracting motion controlling butt 74 of the TR jack controlling member 64 are traveled from right to left. In FIG. 6, the advancing-and-retracting motion controlling butt 54 of the TR jack 6 selected to be in the advanced position in order to transfer the loop from the knitting needle 16*b* of the back bed 2*b* to the TR jack is moved along the track "e" and the advancing-and-retracting motion controlling butt 74 of the TR jack controlling member 64 selected is moved along the track "f".

After the completion of the loop transfer from the knitting needle 16*b* of the back bed 2*b* to the TR jack 6 and the racking of the back bed 2*b,* the carriage 30*a* is reversed and starts traveling in the direction indicated by the arrow Y. When the TR jack 6 is moved up to the position E of FIG. 6, the knitting needle 16*b* to receive the loop 36 is advanced, so that the hook 34 of the knitting needle 16*b* is advanced into the loop 36. At this time, the TR jack 16 and the TR jack controlling member 64 are in engagement with each other, so that the loop retaining portion 48 is held in its raised position.

In the position F, the TR jack controlling member 64 is further moved toward the needle bed gap by the guide cam 94. As a result of this, the rear end portion 66 of the TR jack controlling member 64 is moved away from the engaging surface 68 of the TR jack 6, so that the engagement between the TR jack 6 and the TR jack controlling member 64 is released. Then, the clearing cam 98 mounted on the second cam group 86 of the TR jack control cam 82 acts on the clearing cam action portion 56 of the TR jack 6 to force the TR jack 6 to swing around the virtual axis 60, so as to lower down the loop retaining portion 48 to its lowered position. At this swinging motion of the TR jack 6, the rear end portion 66 of the TR jack controlling member 64 is slotted into the notch 70 formed in the recess 62 of the TR jack 6.

When the engagement between the TR jack 6 and the TR jack controlling member 64 is released, the loop retaining portion 48 of the TR jack 6 is lowered down to some extent by the tensile force of the loop 36 retained on the loop retaining portion 48. In the illustrated embodiment, the TR jack control cam 82 is provided with a clearing cam 98, to ensure that the loop retaining portion 48 is lowered down to its lowered position.

In the position G, the TR jack 6 is retracted, so that the loop retaining portion 48 which is in the lowered position is pulled out from the loop 36. At this time, the loop retaining portion 48 of the TR jack 6 is in its lowered position. Accordingly, when the loop 36 goes out of the loop retaining portion 48, the load put on the loop 36 is reduced and also the loop 36 is reliably retained in the hook 34 of the knitting needle 16*b*.

In the position H, the TR jack 6 is further retracted and the TR jack controlling member 64 is also retracted. This retracting motion of the TR jack 6 brings the protrusion 72 at the bottom of the TR jack 6 into abutment with the top of the TR jack bed 8, so that the loop retaining portion 48 of the TR jack 6 is returned to its raised position. This causes the rear end portion 66 of the TR jack controlling member 64 to ride on the engaging surface 68 of the TR jack 6 and brings the TR jack 6 and the TR jack controlling member 64 into engagement with each other. As a result of this, the loop 36 is released from the TR jack 6, and the loop transfer from the TR jack 6 to the knitting needle 16*b* is completed.

While in the illustration, the loop transfer between the TR jack 6 and the knitting needle 16*b* of the back bed 2*b* has been described above, the same operation is yielded for the loop transfer between the TR jack 6 and the knitting needle 16*a* of the front bed 2*a*.

Thus, according to the present invention, when the TR jack 6 is put in its advanced position, the TR jack 6 can selectively hold the loop retaining portion 48 in its raised position and release it from that held state.

Figure 8:
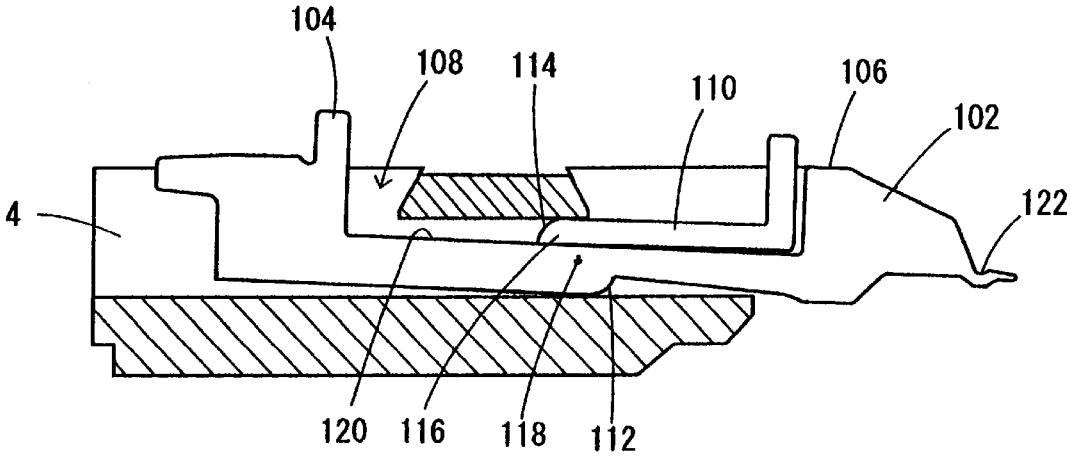
FIG. 8 shows the second embodiment of the invention.

Next, description on the second embodiment of the present invention will be given with reference to FIG. 8.

In the second embodiment as well, a TR jack 102 is held in a TR jack groove 4, and the TR jack 102 has on the top an advancing-and-retracting motion controlling butt 104 and a clearing cam acting portion 106 and also has a recess 108 formed therebetween. A TR jack controlling member 110 is slidably fitted in the recess 108.

In the second embodiment, the notch is not formed in the recess 108 of the TR jack 102, but instead, a circular arc 112 is formed on a bottom of the TR jack 102 and a circular arc 114 is formed on a top of the TR jack controlling member 110 at a rear end thereof, those circular arcs 112, 114 being made to have the same curvature, which is different in construction from the previous embodiment.

When the TR jack 102 is put in its advanced position, the TR jack controlling member 110 is moved forward of the recess 108 of the TR jack 102 until the center of the circular arc 112 formed on the TR jack 102 and the center of the circular arc 114 formed on the TR jack controlling member 110 come to coincides with each other. The TR jack 102 cannot be swung until the center of the circular arc 112 and the center of the circular arc 114 comes to coincides with each other. Also, when a rear end portion 116 of the TR jack controlling member 110 is located on an engaging surface 120 located rearward of a virtual axis 118 of the TR jack controlling member 110 in the recess 108 of the TR jack 102, the TR jack 102 is not swung, so that a loop retaining portion 122 of the TR jack 102 is held in its raised position.

In the embodiment illustrated above, when the needle bed 2*b* is racked after the completion of the loop transfer from the knitting needle 16*b* to the TR jack 6, the loop retaining portion 48 of the TR jack 6 which is in its advanced position is held in its raised position. This raised position is intended to mean that the loop retaining portion 48 is raised up to a position at least as high as a level to avoid interference with knitting members arranged on the needle beds 2*a*, 3*b*.

While in the illustrated embodiment, the TR jack 6 is structured to move linearly in the horizontal direction from the retracted position to the advanced position, this structure may be modified such as, for example, by the loop retaining portion of the TR jack being lowered for a while before it reaches the advanced position, first, and, then, the TR jack located in the advanced position being made to selectively hold the loop retaining portion in its raised position and release it from that held state. Alternatively, the TR jack may be moved in the horizontal direction from its lowered position and, when located in its advanced position, may selectively hold the loop retaining portion in its raised position and release it from that held state.

Although the flat knitting machine 1 including the slide needles as the knitting needles 16*a*, 16*b* and the fixed sinkers 44*a*, 44*b* has been illustrated in the embodiments above, the present invention may be practically worked even by using latch needles for the knitting needles and movable sinkers in place of the fixed sinkers.

While preferred embodiments of the invention have been illustrated above, it is to be understood that the present invention is not limited thereto but may practically be embodied variously within the sprit and scope of the present invention.

Capabilities of Exploitation in Industry

As mentioned above, the present invention enables the loop retaining portion of the TR jack to be selectively held in its raised position and released from its held state when the TR jack is in its advanced position. Hence, possible interference of the TR jack with the knitting members can be avoided by holding the loop retaining portion in its raised position when the needle bed is racked. In addition, the load put on the loop can be reduced by lowering down the loop retaining portion to its lowered position when the TR jack is located in its advanced position.

Also, when the TR jack is put in the advanced position, the loop retaining portion can be held in its raised position and released from its held state by simply moving the TR jack controlling member. The loop retaining portion can be held in its raised position by bringing the TR jack controlling member into engagement with the TR jack. The loop retaining portion can be lowered down to its lowered position by releasing the engagement between the TR jack controlling member and the TR jack. Consequently no complicated structure is required for holding the loop retaining portion in its raised position and releasing it from its held state.

Also, the engaging portion for the TR jack and the rear end portion of the TR jack controlling member to be engaged with each other and the notch for the rear end portion of the TR jack controlling member to be inserted into when the TR jack is swung are formed in the recess formed in the TR jack. With this construction, the feature that the loop retaining portion can selectively be held in its raised position when the TR jack is in the advanced position and the feature that the TR jack can be swung when the loop retaining portion is released from the state of being held in the raised position can both be provided without any complicated structure.

What is claimed is:

1. A flat knitting machine with a loop transfer mechanism comprising a pair of front and back needle beds, arranged in a confronting relation and holding knitting needles in such a manner as to freely advance and retract in grooves formed in upper surfaces of the needle beds, at least one of which is racked relative to the opposite needle bed, and at least one transfer jack bed, provided over the at least one needle bed and holding transfer jacks, each having a loop retaining portion at a front end portion thereof, in such a manner as to freely advance and retract in grooves formed in upper surface of the at least one transfer jack bed, wherein the transfer jack holding means includes a transfer controlling member which is fitted in a recess formed in the transfer jack bed in a freely advance-and-retract manner;

wherein the transfer jack controlling member and the transfer jack are brought into engagement with each other by their relative movement in the advancing-and-retracting direction, whereby the loop retaining portion of the of the transfer jack is held in its raised position when the loop retaining portion is in its advanced position; and wherein when the loop retaining portion is in the advanced position, the transfer jack controlling member is moved to release the engagement between the transfer jack end portion thereof, in such a manner as to freely advance and retract in grooves formed in upper surface of the at least one transfer jack bed, wherein the transfer jack is structured so that when the loop retaining portion is advanced to an advanced position over a needle bed gap between the front and back needled beds, the loop retaining portion can be held in such a manner as to swing between its raised position and its lowered position;

wherein there is provided transfer jack holding means for holding the loop retaining portion in its raised position at least as high as a level to avoid interference with knitting members arranged on the needle beds while the needle bed is racked, when the loop retaining portion of the transfer jack retaining a loop thereon is in the advanced position;

wherein there is provided transfer jack controlling means for controlling the transfer jack holding means to selectively hold the loop retaining portion of the transfer jack in its raised position and release it from its held state;

wherein the transfer jack holding means includes a transfer jack controlling member which is fitted in a recess formed in the transfer jack bed in a freely advance-and-and-retract manner;

wherein the transfer jack controlling member and the transfer jack are brought into engagement with each other by their relative movement in the advancing-and-retracting direction, whereby the loop retaining portion of the transfer jack is held in its raised position when the loop retaining portion is in its advanced position; and wherein when the loop retaining portion is in the advanced position, the transfer jack controlling member is moved to release the engagement between the transfer jack controlling member and the transfer jack, so as to allow the loop retaining portion of the transfer jack to be lowered.

2. The flat knitting machine with the loop transfer mechanism according to claim 1, wherein the recess is formed on a top surface of the transfer jack and the transfer jack controlling member is slidably fitted in the recess; wherein the recess has an engaging portion, formed at a bottom of the recess at a rear end portion thereof, to engage with a rear end portion of the transfer jack controlling member; wherein a notch for the rear end portion of the transfer jack controlling member to be inserted into so as to allow the transfer jack to swing is formed in the bottom of the recess at a location forward of the engaging portion; and wherein the transfer jack controlling means puts the transfer jack controlling member in a location at a rear of the recess to bring the transfer jack and the transfer jack controlling member into engagement with each other and puts the transfer jack controlling member in a location at a front of the recess to release the engagement between the transfer jack and the transfer jack controlling member.

* * * * *